US007690519B2

(12) United States Patent
Kahl et al.

(10) Patent No.: US 7,690,519 B2
(45) Date of Patent: Apr. 6, 2010

(54) EXTENDABLE PRODUCT SHELVING

(75) Inventors: William Henry Kahl, Mason, OH (US); Jeremy David Jarrett, Cincinnati, OH (US)

(73) Assignee: Display Specialties, Inc., Wilder, KY (US)

( * ) Notice: Subject to any disclaimer, the term of this patent is extended or adjusted under 35 U.S.C. 154(b) by 172 days.

(21) Appl. No.: 12/045,576

(22) Filed: Mar. 10, 2008

(65) Prior Publication Data

US 2009/0223916 A1 Sep. 10, 2009

(51) Int. Cl.
*A47F 1/04* (2006.01)
*A47F 7/00* (2006.01)

(52) U.S. Cl. ..... 211/59.2; 211/74; 211/126.1; 211/59.3

(58) Field of Classification Search ..... 211/49.1, 211/59.2, 59.3, 59.4, 74, 75, 88.01, 90.01, 211/126.1, 126.15; 108/102, 105, 106, 108, 108/110; 221/22; 222/181.2, 181.3; 312/334.14, 312/334.15, 334.27, 334.28, 334.29
See application file for complete search history.

(56) References Cited

U.S. PATENT DOCUMENTS 4,466,592 A * 8/1984 Janson ..... 248/220.22
4,478,337 A * 10/1984 Flum ..... 211/59.2
4,479,583 A 10/1984 Franklin et al.
4,494,658 A * 1/1985 Simon et al. ..... 211/49.1
4,685,574 A * 8/1987 Young et al. ..... 211/59.2
4,730,741 A * 3/1988 Jackle et al. ..... 211/59.3
4,762,236 A * 8/1988 Jackle et al. ..... 211/59.3
4,923,070 A * 5/1990 Jackle et al. ..... 211/59.2
5,012,936 A 5/1991 Crum
5,645,176 A * 7/1997 Jay ..... 211/59.2
5,665,304 A * 9/1997 Heinen et al. ..... 312/71
5,673,801 A * 10/1997 Markson ..... 211/59.3
5,855,283 A * 1/1999 Johnson ..... 211/59.3
6,164,462 A 12/2000 Mumford
6,276,538 B1 8/2001 Battaglia et al.
6,439,400 B2 8/2002 Battaglia et al.
6,513,667 B2 2/2003 Battaglia et al.
6,702,127 B2 3/2004 Primiano
6,715,621 B2 4/2004 Boron
6,889,854 B2 * 5/2005 Burke ..... 211/59.3
7,124,898 B2 10/2006 Richter et al.
2004/0140278 A1 * 7/2004 Mueller et al. ..... 211/59.3
2005/0046317 A1 * 3/2005 Howard ..... 312/334.27
2005/0092703 A1 * 5/2005 Mueller et al. ..... 211/59.3
2006/0186065 A1 * 8/2006 Ciesick ..... 211/59.3
2006/0196840 A1 9/2006 Jay et al.
2007/0272634 A1 * 11/2007 Richter et al. ..... 211/59.3

* cited by examiner

*Primary Examiner*—Marvin M Lateef
*Assistant Examiner*—Patrick Hawn
(74) *Attorney, Agent, or Firm*—Wood, Herron & Evans, L.L.P.

(57) ABSTRACT

A product shelf unit specially adapted for yogurt cups and the like, includes a metal base bracket that attaches to a horizontal rectangular bar. A plastic tray is slidably received on the base bracket which has two elongated walls which slide within the hollow interior of elongated walls in the tray. The base bracket includes lateral projections that engage stop members in the tray which keep the tray in a rearward position. The front end of the tray is lifted up, allowing it to slide forwardly for restocking.

8 Claims, 4 Drawing Sheets

EXTENDABLE PRODUCT SHELVING

BACKGROUND OF THE INVENTION

In grocery stores, it is very important to carry as much product as possible in as small an area as possible. The product also must be apparent to the consumer and attractively displayed.

One way to increase product density is to place the product on shelving with only a minimal amount of space between the top of the product and the bottom of the next higher shelf. This presents difficulties with respect to the visual appeal, as well as in stocking the shelves. When restocking a shelf, the older product needs to be positioned at the front of the shelf. This is particularly an issue with perishable products, such as dairy products such as yogurt, and the like. The limited space between shelves makes it difficult for the store employees to restock the product.

There are shelving units that are supported on either side by rollers that allow the shelves to slide outwardly for restocking. This arrangement is not optimal for refrigerated display cases that support dairy products. Further, it is always desirable to minimize costs.

SUMMARY OF THE INVENTION

The present invention is an extendable shelf suitable for supporting dairy products such as yogurt, which includes a plastic tray separated into individual columns by walls. The tray is supported on a metal bracket. Walls on the bracket fit within walls of the tray and allow the tray to slide relative to the bracket. The tray is preferably supported at a slight angle to gravity feed the yogurt containers from the back to the front. The tray can be pulled outwardly for restocking and can be pushed back to its original position subsequent to restocking.

The objects and advantages of the present invention will be further appreciated in light of the following detailed description and drawings in which:

DETAILED DESCRIPTION

Figure 1:
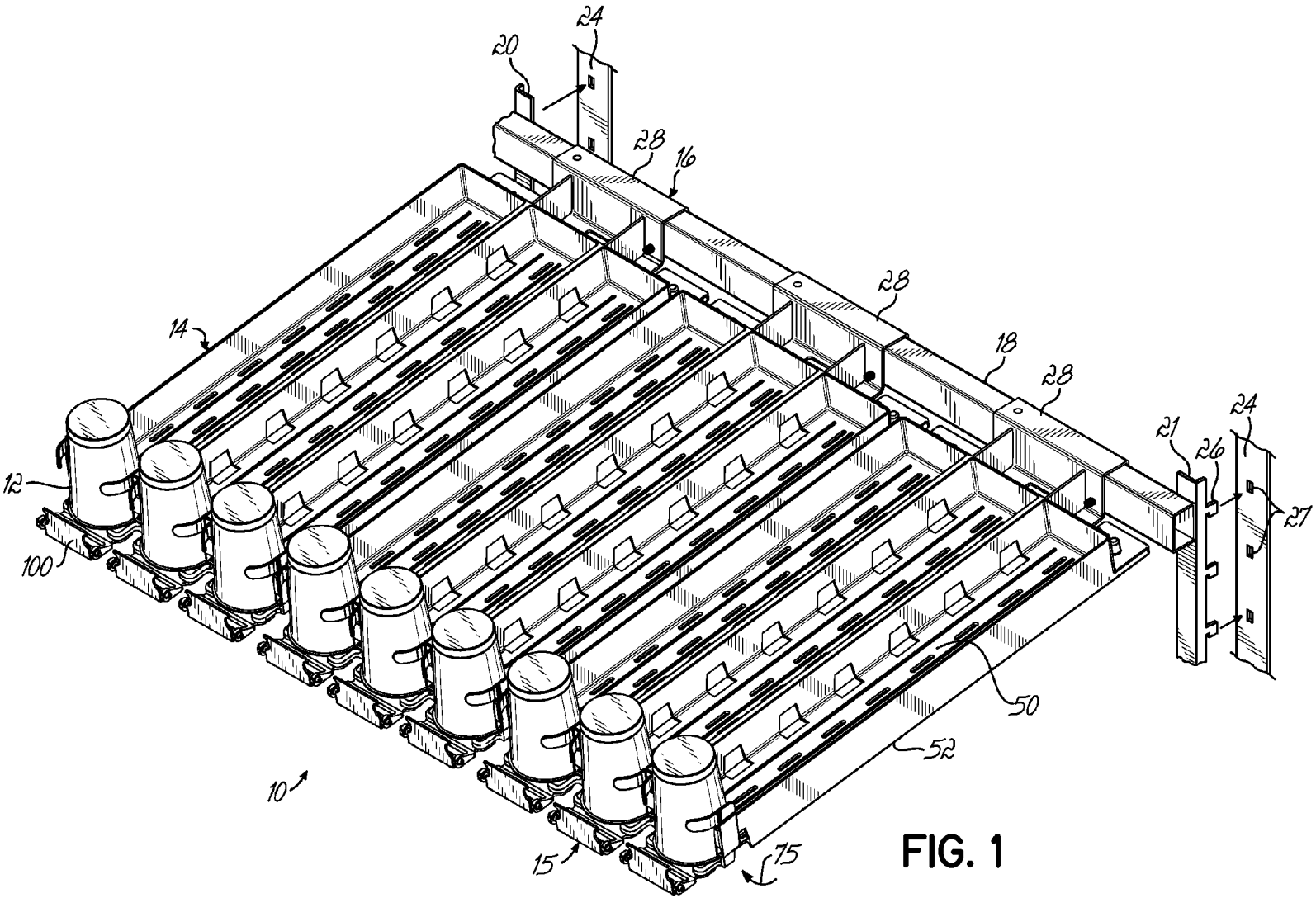
FIG. 1 is a perspective view of the present invention.
Figure 2:
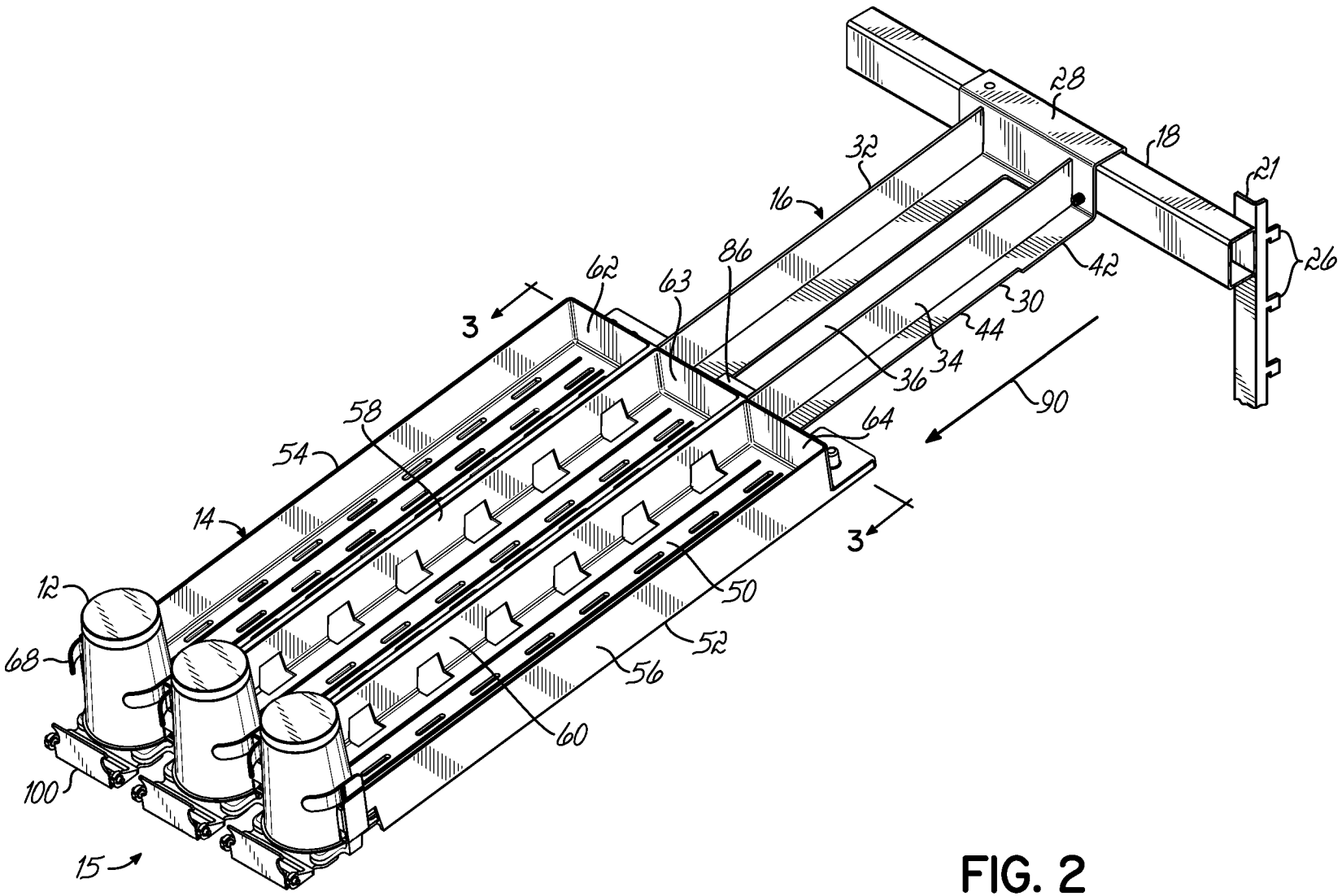
FIG. 2 is a perspective view of the present invention in an extended position.

As shown in FIG. 1, the present invention is a product shelf unit 10 which is designed to hold a plurality of containers of yogurt 12. The shelf unit 10 includes a plastic tray 14 supported by a metal bracket 16. Bracket 16 is supported on a horizontal bar 18 which is bolted or otherwise attached to vertical supports 20 and 21. The vertical supports 20 and 21 include a plurality of L-shaped members 26 which allow them to be attached to vertical supports 22 and 24 of a refrigerated display case. As shown, the L-shaped members 26 simply fit into the slots 27 of the vertical supports 22 and 24, holding the horizontal bar 18 in position and, thus, holding the bracket 16 and tray 14 in position. As shown in FIG. 1, there will be multiple spaced horizontal bars 18 fixed to the vertical supports 20 and 21 with a plurality of shelf units 10 fixed side by side on each bar 18.

Figures 4, 5:
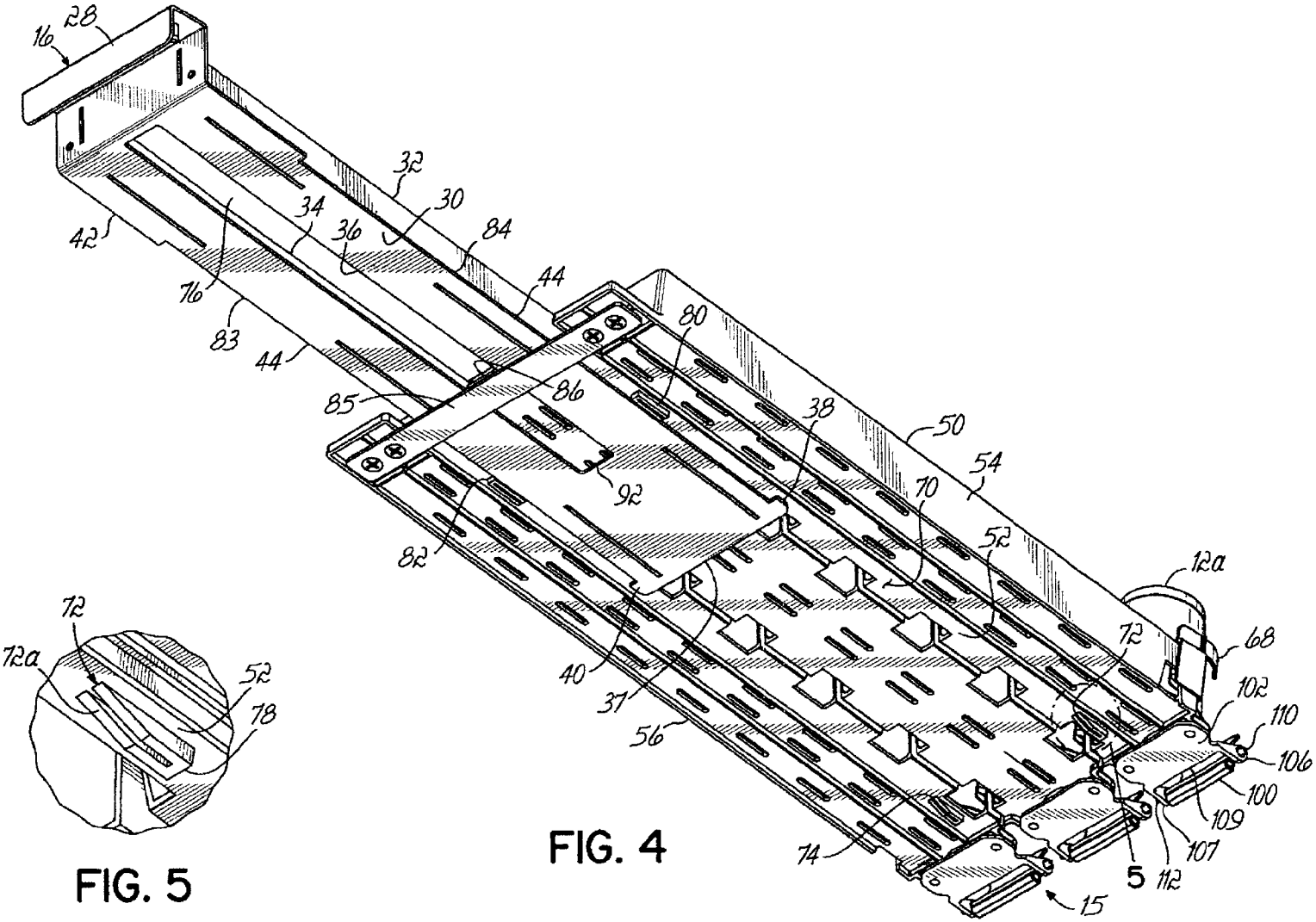
FIG. 4 is a bottom perspective view of the present invention.
FIG. 5 is an enlargement of the circle 5 from FIG. 4.

Bracket 16 preferably formed from metal includes a C-shaped clamp 28 and a planar base 30 extending from the clamp 28. The base 30 slopes downwardly about 8° from normal. Extended along base 30 are first and second elongated walls 32 and 34. Walls 32 and 34 are perpendicular to base 30. Base 30 includes an open portion 36 between the walls 32 and 34. As seen in FIG. 4, the forward most edge 37 of base 30 includes lateral projections 38 and 40. Further, the rear section 42 of base 30 is wider than the middle section 44.

The tray 14, in turn, includes a top side 50, bottom side 52 and outer walls 54 and 56, and interior hollow walls 58 and 60. These walls divide the tray into three columns 62, 63 and 64. Forward of each column are flexible fingers 68 which engage the forward most yogurt container 12*a*, preventing it from sliding out off the tray 14.

The bottom 52, of tray 14 includes a central planar portion 70 and first and second stop member 72 and 74. As shown in FIG. 5, these stop members have a sloped rear portion 76 and a forward most edge or stop 78 which extends 90° from bottom 52. Rearward of the stop members 72 and 74 are first and second guide members 80 and 82. The distance between the guide members is slightly greater than the width of middle section 44 of bracket 16.

Figure 3:
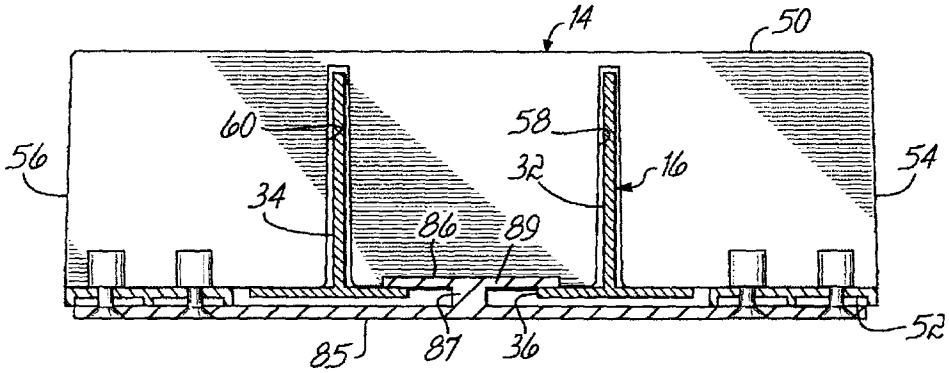
FIG. 3 is a cross sectional view taken at lines 3-3 of FIG. 2.
Figure 6:
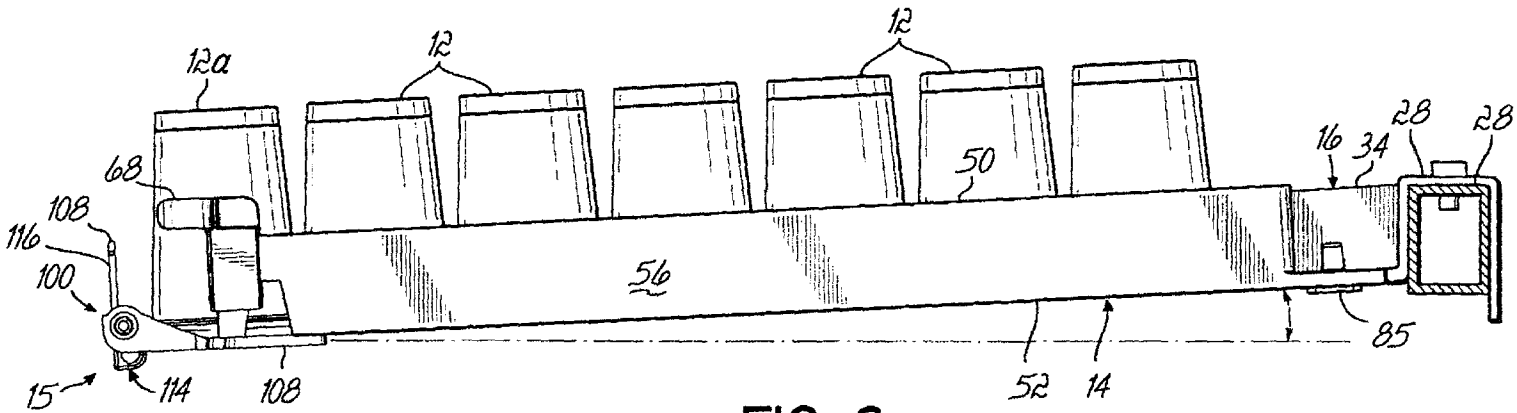
FIG. 6 is a side plan view of the present invention.
Figure 7:
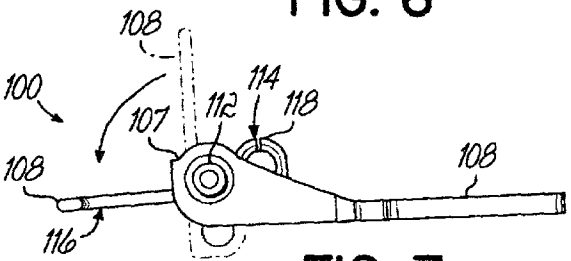
FIG. 7 is a side plan view of the sign holder used in the present invention.

The base 30 of the bracket 16 slides along the central planar portion 70 of tray 14 with the side edges 83 and 84 of base 30 sliding between guides 80 and 82. A bar 85 fastened to the bottom side of tray 14 holds the bracket 16 and tray 14 together. The bar 85 includes an upper T-shaped guide 86. (See FIG. 3.) Guide 86 includes a narrow portion 87 that fits within the open portion 76 of bracket 16. An upper portion 89 is wider than open portion 76 and holds the tray 14 to the bracket 16. Vertical walls 32 an 34 of bracket 16 slide within the hollow interior portion of hollow vertical walls 58 and 60 of tray 14. This provides strength and stability to the shelf unit 10.

In its normal or retracted position, tray 14 rests on bracket 16 with the lateral projections 38 and 40 engaging stop members 72 and 74. The tray 14 is moved outwardly relative to the bracket 16 by lifting the front 15 of the tray upwardly, as shown by arrow 75, so that the barrier 78 no longer engages the lateral projections 38 and 40, which, in turn, allows the tray to slide forwardly in the direction of arrow 90. As the tray moves outwardly to its extended position, the lateral projections 38,40 will engage the guides 80 and 82, which will limit the movement of the tray 14 relative to the bracket 16. Further, the T-shaped guide 86 will engage the end 92 of the slotted portion 36, again limiting the forward movement of the tray. In this position, the tray 14 can be easily restocked.

The tray 14 is moved back to its normal position by pushing it back relative to bracket 16. The sloped portion 72(*a*)of the stop members 72/74 allows the lateral projections 38,40 to slide under the stop members 72,74. The front barrier 78 of step member 72,74 will hold the tray in position relative to the bracket 16.

The front 15 of the tray, in addition to the fingers 68, incorporates a sign holder 100 which has a base 102 fixed to the front end 15 of tray 14. Base 102 has first and second lateral tabs 106 and 107 which extend forwardly, leaving a space 109 between the tabs. A pivoting member 108 includes posts 110 and 112 which fit into tabs 106 and 107. The pivoting member 108 includes a lower portion 114 below posts 110 and 112 and an upper portion 16 above posts 110 and 112. The upper portion 116 is designed to hold a price tag or other signage. The lower portion 114 includes a rearwardly extended portion 118, which simply adds weight, making the lower portion 114 heavier than the upper portion 116. As shown in FIG. 4, the space 109 between tabs 106 and 107 provides clearance for this lower portion 114 so that it can rotate from an upright position to a flat position so that the cups of yogurt 12 can be removed from the tray 14. Because of the mass of the lower portion 114, the sign holder 100 will rotate back to an upright position.

In use, the shelf unit 10 of the present invention is assembled by placing a plurality of the shelf units 10 on horizontal bar 18 which is fixed inside, preferably a refrigerated display case. Generally, several shelving units will be located on several horizontal bars in one display case. A customer grasps the product and the sign holder rotates into the position shown in FIG. 5, allowing the individual to take the product from the tray. Because the tray is sloped, gravity forces the remaining product in the column downwardly until the forward most product is grasped by the fingers.

This allows a substantial amount of product to be held in a refrigerated display case, taking up a minimal amount of space. It provides for simple and easy restocking of the shelves and, further, the product is relatively simple and, therefore, inexpensive.

This has been a description of the present invention along with the preferred method of practicing the present invention. However, the invention itself should only be defined by the appended claims, wherein

We claim:

1. A product shelf unit comprising a tray and a bracket;

a back portion of said bracket fixed to a support;

said bracket including a bracket base and first and second elongated vertical walls extended from said back portion, said tray including a tray base and first and second vertical dividers separating said tray base into columns comprising a plurality of flexible fingers at the end of each column;

said tray further comprising pivoting sign holders forward of each column;

said sign holders pivoting flush with said tray base to permit product to pass over said sign holder;

said first and second elongated vertical dividers having hollow interiors wherein said first and second elongated vertical walls are slidably engaged within said vertical dividers.

2. The shelf unit claimed in claim 1 wherein said bracket base further includes at least one stop member adapted to engage a stop portion on a bottom of said tray.

3. The shelf unit claimed in claim 2 wherein said stop member has a sloped rear side.

4. The shelf unit claimed in claim 2 wherein said bracket base connects said first and second walls.

5. The shelf unit claimed in claim 4 wherein said bracket base includes an elongated open portion and wherein said tray has a bar having a guide member, said guide member riding in said open portion of said bracket base.

6. The shelf unit claimed in claim 1 wherein said sign holder is weighted to rotate back to an upright position.

7. The shelf unit claimed in claim 1 wherein said bracket base includes a C-shaped clamp fixed to a horizontal rectangular bar adapted to be fixed to the back of a display case and wherein said C-shaped clamp fits over said rectangular bar.

8. The shelf unit claimed in claim 7 wherein said horizontal bar is attached to vertical supports.

* * * * *